US005950061A

United States Patent [19]

Ota et al.

[11] Patent Number: 5,950,061

[45] Date of Patent: Sep. 7, 1999

[54] FIXING MEMBER HAVING AN INNER ELASTIC LAYER WITH A SURFACE ROUGHNESS

[75] Inventors: Mitsuhiro Ota, Susono; Takeshi Menjo, Suntou-gun; Kazuo Kishino, Kawasaki; Hideo Kawamoto, Tokyo, all of Japan

[73] Assignee: Canon Kabushiki Kaisha, Tokyo, Japan

[21] Appl. No.: 08/978,376

[22] Filed: Nov. 25, 1997

[30] Foreign Application Priority Data

Nov. 29, 1996 [JP] Japan ..... 8-319481

[51] Int. Cl.[6] ..... G03G 15/20

[52] U.S. Cl. ..... 399/333; 492/56

[58] Field of Search ..... 399/330, 333; 219/216, 469; 432/60; 492/53, 56

[56] References Cited

U.S. PATENT DOCUMENTS

| | | | |
|---|---|---|---|
| 4,616,917 | 10/1986 | Sakurai | 399/324 |
| 4,883,715 | 11/1989 | Kuge et al. | 492/56 X |
| 5,049,943 | 9/1991 | Menjo et al. . | |
| 5,068,692 | 11/1991 | Menjo . | |
| 5,153,660 | 10/1992 | Goto | 399/331 |
| 5,243,393 | 9/1993 | Menjo . | |
| 5,285,248 | 2/1994 | Menjo et al. . | |
| 5,319,427 | 6/1994 | Sakurai et al. . | |
| 5,420,679 | 5/1995 | Goto et al. . | |
| 5,608,508 | 3/1997 | Kumagai et al. . | |

FOREIGN PATENT DOCUMENTS

| | | |
|---|---|---|
| 3-81135 | 4/1991 | Japan . |

*Primary Examiner*—Joan Pendegrass
*Attorney, Agent, or Firm*—Fitzpatrick, Cella, Harper & Scinto

[57] ABSTRACT

A fixing member includes a plurality of elastic layers on a core member, at least one elastic layer L1 among these elastic layers being overlaid on an elastic layer L2 having a surface roughness Rz of 10 $\mu$m or more. The fixing member has a high heat conductivity, and the temperature depression of a fixing roller is moderated in a continuous paper feeding process.

7 Claims, 9 Drawing Sheets

CONVENTIONAL ROLLER

FIXING MEMBER HAVING AN INNER ELASTIC LAYER WITH A SURFACE ROUGHNESS

BACKGROUND OF THE INVENTION

1. Field of the Invention

The present invention relates to fixing members and fixing apparatuses which are used in image forming apparatuses, such as electrophotographic apparatuses and electrostatic recording apparatuses.

2. Description of the Related Art

Among known image forming apparatuses, electrophotographic image forming apparatuses have been widely used. In the electrophotographic image forming apparatuses, images are obtained by exposing photosensitive members with laser light beams followed by developing. Such image forming apparatuses have some advantages, for example, high image quality and high speed image formation process, and thus have been used in output units of copying machines, color laser beam printers, and the like.

FIG. 2 is a cross-sectional view of a typical color copying machine. The color copying machine shown in FIG. 2 includes a document read unit I provided on the top of the machine, a latent image forming unit II provided below the document read unit I, rotatable developing unit III serving as developing means provided near the latent image forming unit II, and a recording material carrier unit IV provided on the right side of the apparatus body 1.

In FIG. 2, the document read unit I scans a document by reciprocal movement in the transverse direction. A CCD camera (not shown in the drawing) is provided just under the document read unit I, and the image on the document is formed in the CCD. The image is output from the CCD as electric signals which are processed in a signal processing circuit. A photosensitive drum 19 is irradiated with laser beams in response to color signals from the signal processing circuit to form a latent image.

The latent image forming unit II is provided with the photosensitive drum 19 which rotates in the direction of the arrow B in FIG. 2 and holds the latent image. Along the surface of the photosensitive drum 19, a discharger 20, a cleaning means 21, and a primary charger 23 are provided in that order in the rotation direction of the photosensitive drum 19. An image exposure means 24, such as a laser beam scanner, and a laser beam reflecting means 25, such as a mirror, are provided above the photosensitive drum 19 in order to form electrostatic latent images on the photosensitive drum 19.

Laser beams E are emitted from the image exposure means 24 based on yellow ($Y_3$), magenta ($M_3$), cyan ($C_3$), and black ($Bk_3$) signals, reflected by the laser beam reflecting means 25, and radiated onto the photosensitive drum 19 to form the electrostatic latent images which are developed into a visual image with the rotatable developing unit III.

The rotatable developing unit III faces the surface of the photosensitive drum 19 and includes four developing sections provided along the rotation direction, that is, a yellow developing section 27Y, a magenta developing section 27M, a cyan developing section 27C, and a black developing section 27Bk, which develop their respective colors using developers in response to the electrostatic latent images based on the $Y_3$, $M_3$, $C_3$, and $Bk_3$ signals. The visual developed image on the photosensitive drum 19 is transferred onto a recording material which is fed with the recording material carrier unit IV.

The recording material transfer unit IV has the following configuration. Detachable recording material feeders 2 and 3 are inserted into openings provided on the right wall of the apparatus body 1 such that the recording material feeders 2 and 3 partially protrude from the apparatus body 1. Feeding rollers 4 and 5 are provided just above the recording material feeders 2 and 3, respectively. A plurality of feeding rollers 6 and feeding guides 7 and 8 are provided to convey a recording material from one of the feeding rollers 4 and 5 to a transfer drum 15 which rotates in the direction of the arrow A. On or near the surface of the transfer drum 15, a contact roller 9, a gripper 10, a charger 11 for removing the recording material, and a separation nib 12 are arranged in that order along the rotation direction of the transfer drum 15. A transfer charger 13 and a charger 14 for removing the recording material are arranged inside the transfer drum 15.

A transfer sheet (not shown in the drawing) composed of polyvinylidene fluoride is adhered to a region on the recording drum 15 so that the recording material comes into close electrostatic contact with the region. Towards the upper right direction from the transfer drum 15, a carrying belt unit 16 is arranged near the separation nib 12, and a fixing unit 18 is arranged at the right end of the carrying belt unit 16. A detachable ejector 17 for the recording material is arranged on the right side of the fixing unit 18 such that the ejector 17 protrudes from the apparatus body 1.

A sequential operation of the above-mentioned color copying machine will be described with reference to a full color mode. The photosensitive member on the photosensitive drum 19, rotating in the direction of the arrow B, is uniformly discharged with the primary charger 23. The apparatus shown in FIG. 2 has an operational speed (hereinafter referred to as a process speed) of 160 mm/sec. After uniform charging of the photosensitive member with the primary charger 23, a laser beam E, which is modulated with the yellow image signal $Y_3$ from a document 101, is radiated to form a yellow latent image on the photosensitive drum 19, and the yellow latent image is developed with a yellow developing unit 27Y moved to a developing position by the rotation of a rotator.

The recording material, which is fed with the feeding guide 7, the feeding roller 6, and the feeding guide 8, is held with gripper 10 a given length of time, and wound on the transfer drum 15 by an electrostatic force generated with an electrode facing the contact roller 9. The visual image developed with the yellow developing unit 27Y is transferred to the transfer drum 15, which rotates in the direction of the arrow A in synchronization with the photosensitive drum 19, with the transfer charger 13 at the position in which the surface of the photosensitive drum 19 comes into contact with the surface of the transfer drum 15. The transfer drum 15 further rotates for the transfer of the next color (magenta in FIG. 8).

The photosensitive drum 19 is discharged with the discharger 20, cleaned with a conventional blade cleaning means 21, recharged with the primary charger 23, and then subjected to exposure of the magenta image in response to magenta image signals. The rotatable developing unit III rotates to form a magenta electrostatic latent image on the photosensitive drum 19 and to develop the magenta latent image with the magenta developing unit 27M at the given position. The same procedure is repeated to form cyan and black visual images. After completion of four-color image transfer, the four-color image formed on the recording material is deelectrified with the chargers 20 and 14, released from the gripper 10, separated from the transfer drum 15 with the separation nib 12, carried on the carrying belt 16 to the fixing unit 18, and fixed by heat and pressure. The sequence of the full color printing process is completed in such a manner, and a full color printed image is formed.

In the fixing unit 18, as shown in FIG. 3, a fixing roller 29 provided with a halogen heater 36 as a heating means and a pressure roller 30 provided with a halogen heater 37 are pressed to each other with a total pressure of 40 kg using a pressure mechanism (not shown in the drawing). A thermistor 38 in contact with the pressure roller 30 detects the temperature of the pressure roller 30 to control the halogen heater 36 and 37 with a control unit 39 such that the fixing roller 29 and the pressure roller 30 are maintained at approximately 150° C. A developer composed of a toner having a sharp-melt characteristic (hereinafter referred to as sharp-melt toner), which is transferred onto the recording material P, is thereby satisfactorily heated and fixed.

Since the sharp-melt toner has large affinity and is easily transferred to the fixing roller, high releasing characteristics must be maintained on the fixing unit for a long time. The fixing unit shown in FIG. 3 is therefore provided with an oil coating unit O for applying a releasing agent, a cleaning unit C, a cleaning blade C1 for removing oil and contaminants on the pressure roller 30 in order to further improve release characteristics. In the oil coating unit O, a dimethyl silicon oil 41 (made by Shin-Etsu Chemical Co., Ltd., trade name: KF96, viscosity: 300 cs) is stored in an oil pan 40 and applied onto the fixing roller 29 with an oil feeding roller 42 and an oil coating roller 43 while regulating the volume of the oil using an oil regulating blade 44. In the cleaning unit C, a nonwoven fabric web 46 composed of Nomex (trade name) is pressured onto the fixing roller 29 using a pressure roller 45 to clean the fixing roller 29. The web 46 is wound with a winding unit (not shown in the drawing) to prevent the deposition of the toner on the contact section.

In the fixing unit 18, as shown in FIG. 3, the fixing roller 29 is composed of an aluminum core bar 31, a high temperature vulcanization (HTV) type silicone rubber layer 32 formed thereon, and a room temperature vulcanization (RTV) type silicone rubber layer 33 as an outer heat-resistant elastic layer, and the entire rubber layer has a thickness of 3 mm and a diameter of 40 mm. The pressure roller 30 is composed of an aluminum core bar 34, a HTV silicone rubber layer 35*a* having a thickness of 1 mm formed thereon, and a fluorine resin surface layer 35*a*, and has a diameter of 40 mm. Such a combination of the fixing roller 29 and the pressure roller 30 enhances releasing characteristics of the sharp-melt toner on the fixing roller 29.

Color copying machines have become widespread in recent years and have needed to respond to a demand for high-speed copying operation and convenience in use, which are comparable to monochrome copying machines, that is, automatic copying on both sides of a recording material, use of various sizes of paper, such as post cards as well as large paper, use of various thicknesses of paper, and use of particular recording media, such as transparent sheets or OHP films and pack print films.

An improvement in the fixing unit 18 is proposed as a response to various needs. For example, a RTV or LTV silicone rubber having high releasing characteristics is used as a surface layer of the pressure roller 30 in addition to the fixing roller 29 in order to satisfactorily fix images on both sides. At the same time, a large nip is required for achieving high-speed color fixing, and thus a roller having a large diameter, e.g. 60 mm or 80 mm, is used. Further, the use of thick paper inevitably requires improved fixing characteristics with an increased fixing temperature.

Since the surface silicone rubber layer of the pressure roller 30 and the silicone rubber layer of the fixing roller 29 have high affinity to silicon oil, these silicone rubber layers absorb a large amount of silicon oil in use. In particular, absorption of a large amount of oil in the inner silicon layers will cause peeling of the inner silicon layers from the aluminum core bars.

As a result, in high-speed copying machines, a fluorine rubber layer having good oil-resistant characteristics is often provided between the inner silicone rubber layer and the outer silicone rubber layer of each of the fixing roller and the pressure roller in order to prevent peeling.

The triple-layer fixing and pressure rollers, each composed of outer and inner silicone rubber layers and a fluorine rubber interlayer resistant to oil, however, create the following phenomena during high speed color fixing. When the thickness of the inner silicone rubber layer of the fixing roller is increased to help the deformation of the fixing roller in the combination of the multiple-layer fixing and pressure rollers, fixing characteristics deteriorate on occasion during continuous paper feeding because of delayed thermal conduction from the inside to the surface of the fixing roller. For example, the thickness of the inner silicone rubber layer of the fixing roller is increased from 1.3 mm to 2.3 mm while maintaining the thickness of the outer silicon rubber layer at 0.2 mm, and paper is continuously fed while maintaining the roller at 150° C. As shown in FIG. 4, at a thickness of 1.3 mm the heat from the heater is effectively conducted to the surface, hence the temperature rapidly recovers and the minimum temperature of the roller is higher than the minimum fixing temperature (the lower limit of the cold offset temperature), resulting in satisfactory fixing. In contrast, at a thickness of 2.3 mm the heat conduction from the heater is inhibited, hence fixing characteristics deteriorate as shown in the shaded area in FIG. 4.

The RTV silicone rubber used in the surface layer must have high releasing characteristics for sharp-melt toners used in color copying. In general, silicon rubber having high releasing characteristics exhibits low heat conductivity, that is, $\lambda$=0.3 to 0.4, functions as a thermal insulator on the surface of the roller, and thus inhibits thermal transfer onto the recording material. As a result, the heat dissipated by the recording materials during continuous feeding cannot be supplied from the inside, hence the surface temperature of the roller decreases to the extent of not providing satisfactory fixing characteristics on occasion.

In order to improve thermal conduction, a rough surface has been formed on the metallic core bar composed of aluminum, iron, or the like. This technique is effective for mono-layer rubber rollers, but not effective for a multi-layer rubber roller having a thick elastic layer with low heat conductivity, as shown in FIG. 5.

SUMMARY OF THE INVENTION

It is an object of the present invention to provide a fixing member and a fixing apparatus having excellent fixing characteristics during continuous paper feeding even when a material having a low heat conductivity is used in a surface layer.

In accordance with the present invention, a fixing member comprises a plurality of elastic layers on a core member, at least one elastic layer L1 among these elastic layers being overlaid on an elastic layer L2 having a surface roughness Rz of 10 $\mu$m or more.

In the fixing member in accordance with the present invention, the elastic layer L1 is overlaid on the elastic layer L2 having a surface roughness Rz of 10 μm or more, wherein Rz is determined according to JIS B0601-1994, hence the heat from the elastic layer L2 is effectively conducted into the elastic layer L1, and excellent fixing characteristics are maintained during continuous paper feeding.

DETAILED DESCRIPTION OF THE PREFERRED EMBODIMENTS

The present invention will now be described in detail with reference to the drawings.

In a fixing member in accordance with the present invention, it is preferable that an elastic layer L2 having a heat conductivity of $0.6\times10^{-3}$ cal/cm.sec.deg or more, which, is higher than that of the elastic layer L1 be provided between an elastic layer L1, and a core bar as a core member in order to rapidly conduct the heat from the core bar to the elastic layer L1. In such a configuration, the most preferable embodiment is that the elastic layer L2 has a heat conductivity of $0.6\times10^{-3}$ cal/cm.sec.deg or more. Alternatively, an elastic layer having a heat conductivity of $0.6\times10^{-3}$ cal/cm.sec.deg or more may be provided between an elastic layer L2 and the core bar.

It is preferable that the hardness of the elastic layer in the fixing member be low and the nip width be large in order to enhance fixing efficiency of the toner image on the paper by means of a pressing force of the fixing member. An elastic layer having a hardness of 30° or less is, therefore, preferably provided between the elastic layer L1 and the core member. Such an elastic layer having a hardness of 30° or less may serve as elastic layer L2 or be the additonal layer provided between the elastic layer L2 and the core member. It is preferable that an elastic layer having a thickness larger than that of the elastic layer L1 be provided between the elastic layer L1 and the core member in order to increase the nip width. It is more preferable that such an elastic layer having a thickness larger than that of the elastic layer L1 be the elastic layer L2. Preferably, the thickness of the elastic layer L2 is 1 mm or more.

Figure 1:
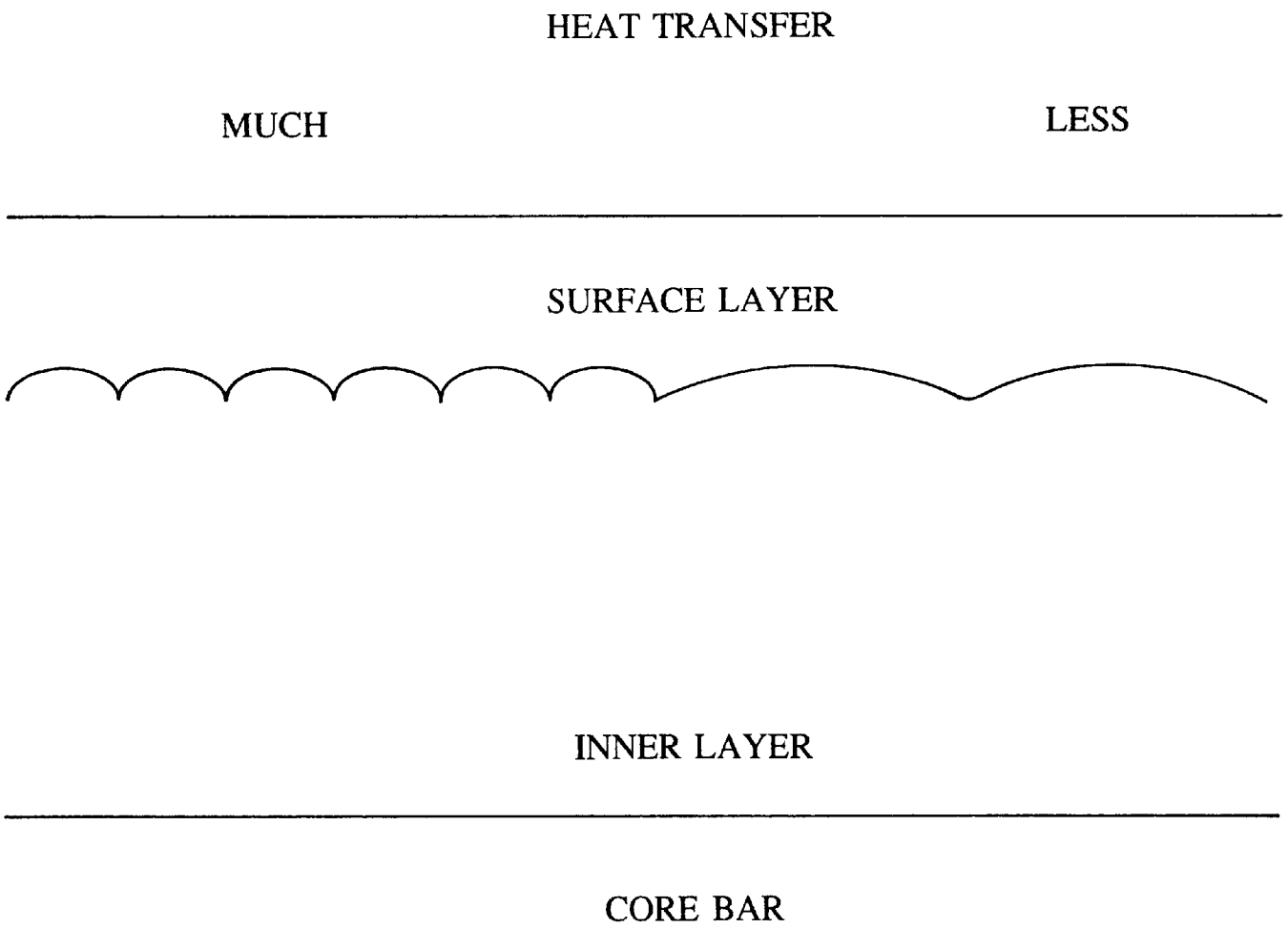
FIG. 1 is a cross-sectional view of an embodiment of a fixing member in accordance with the present invention.
Figure 2:
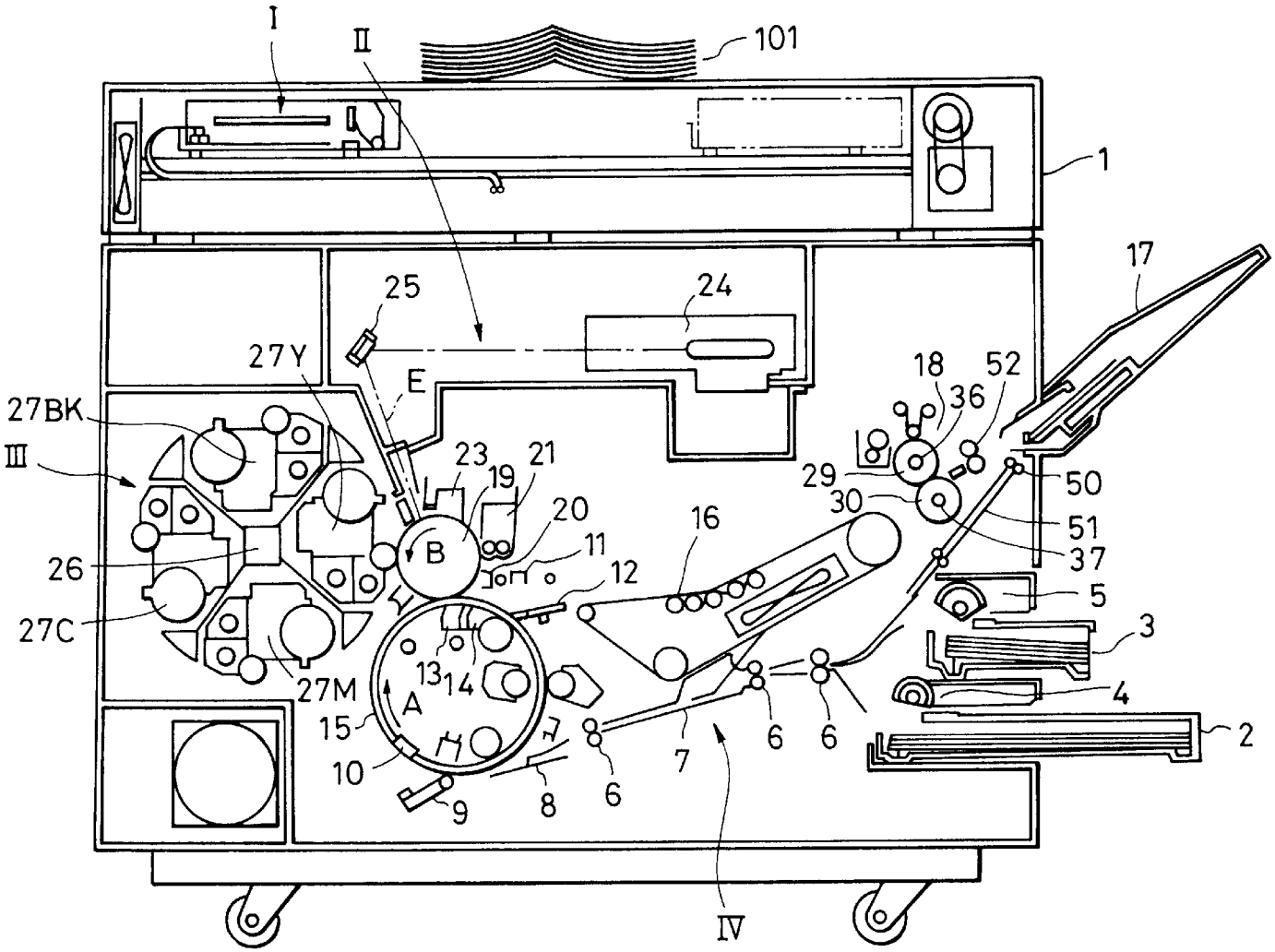
FIG. 2 is a longitudinal cross-sectional view of a conventional copying machine.

FIG. 1 is a cross-sectional view of an embodiment of a fixing member in accordance with the present invention. The fixing member in accordance with the present invention has a plurality of elastic layers on a core bar. Examples of usable materials forming the core bar include aluminum, iron, and stainless steel, and the thickness of the core bar is preferably several mm. Examples of materials for forming a surface layer among the elastic layers include LTV silicone rubber, fluorine rubber, and fluorine resin, and the thickness of the surface layer is preferably several tens of μm to several hundreds of μm. Examples of materials for forming inner layers among the elastic layers include HTV silicone rubber and phenysilicone rubber, and at least one layer among them must have a surface roughness Rz of 10 μm or more. When the surface roughness Rz is less than 10 μm, heat is not conducted sufficiently to the surface layer and thus toner is unsatisfactorily fixed on the recording material. It is preferable that the heat conductivity of the inner elastic layers be $0.6\times10^{-3}$ cal/cm.sec.deg or more. A combination of a heat conductivity of $0.6\times10^{-3}$ cal/cm.sec.deg or more and a surface roughness Rz of 10 μm or more significantly contributes to improvement of the fixing characteristics.

It is preferable that the hardness of the inner elastic layers, according to the Asker C hardness standard, be 30 degrees or less in order to ensure a sufficient nip width and be 1 degree or more in view of the strength of the elastic layer.

The elastic layers may consist of three layers. For example, the inner layers in FIG. 1 consist of a fluorine rubber layer and a silicone rubber layer.

A preferable fixing member is a roller.

EXAMPLE 1

This example relates to the change in heat conductivity of a roller with the surface roughness of an inner rubber layer. The roller has a configuration shown in FIG. 1, the core bar is made of aluminum and has a thickness of 5 mm, the inner rubber layer is made of HTV silicone rubber and has a thickness of 2.3 mm, and the surface layer is made of LTV silicon rubber and has a thickness of 0.2 mm.

Figure 6:
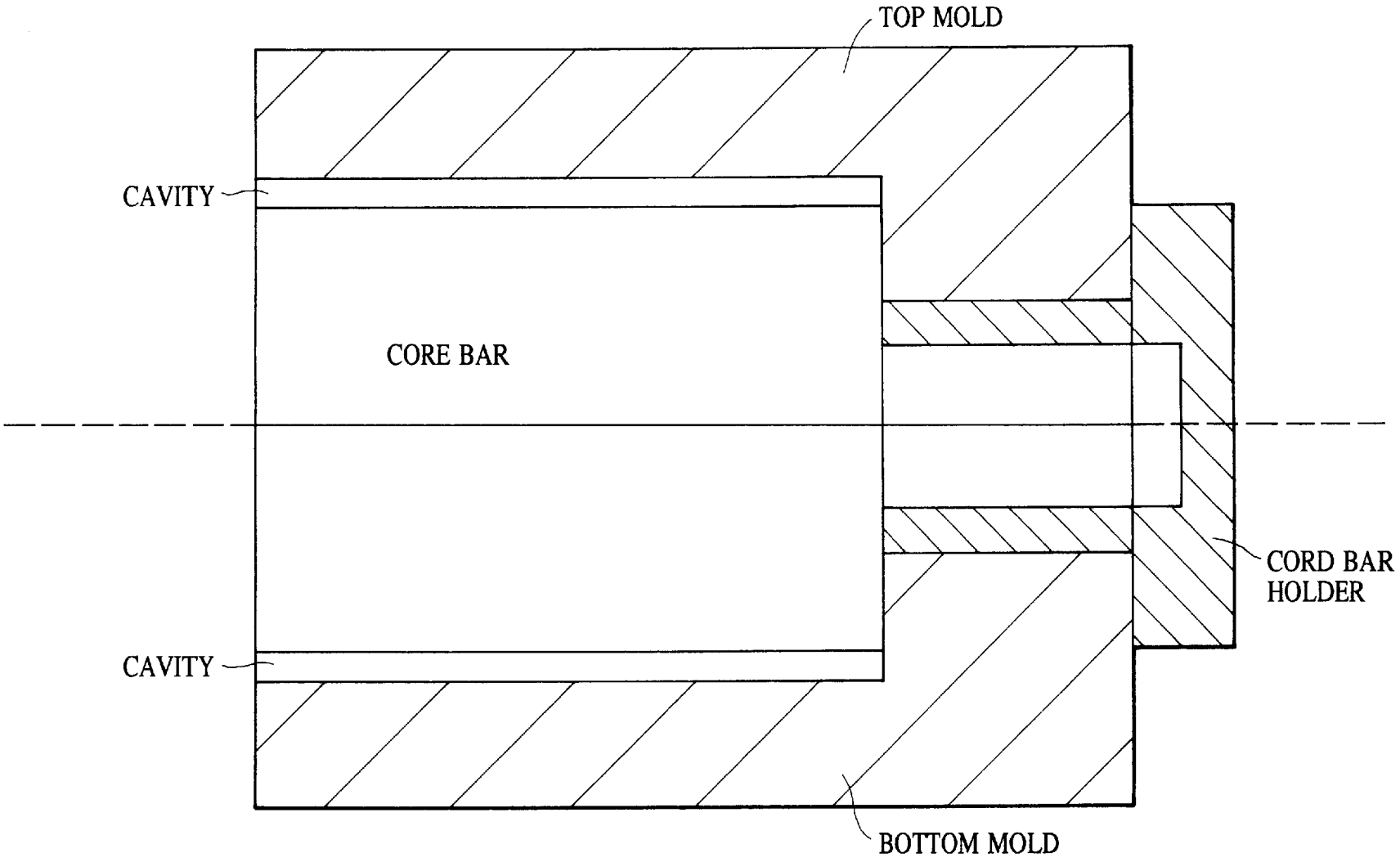
FIG. 6 is a cross-sectional view of a mold for forming an inner rubber layer of a roller.

The inner silicon rubber layer is formed in a compression mold. As shown in FIG. 6, the compression mold consists of a top piece and a bottom piece, and a cavity is provided to form a silicone rubber layer. The core bar is supported with a core bar holder. After applying an adhesive agent on the surface of the metallic core bar, the silicone rubber sheet for the inner layer is wound onto the metallic core bar and then vulcanized at 200° C. for 4 hours. The silicone rubber layer is finished by grinding with a grinding machine. An adhesive agent is applied onto the surface of the finished inner rubber layer, and the surface layer is formed thereon by spray coating and vulcanized at 150° C. for 1 hour.

Heat transfer from one layer to another layer depends on the contact area between them. A larger contact area therefore gives more heat transfer.

Figure 7:
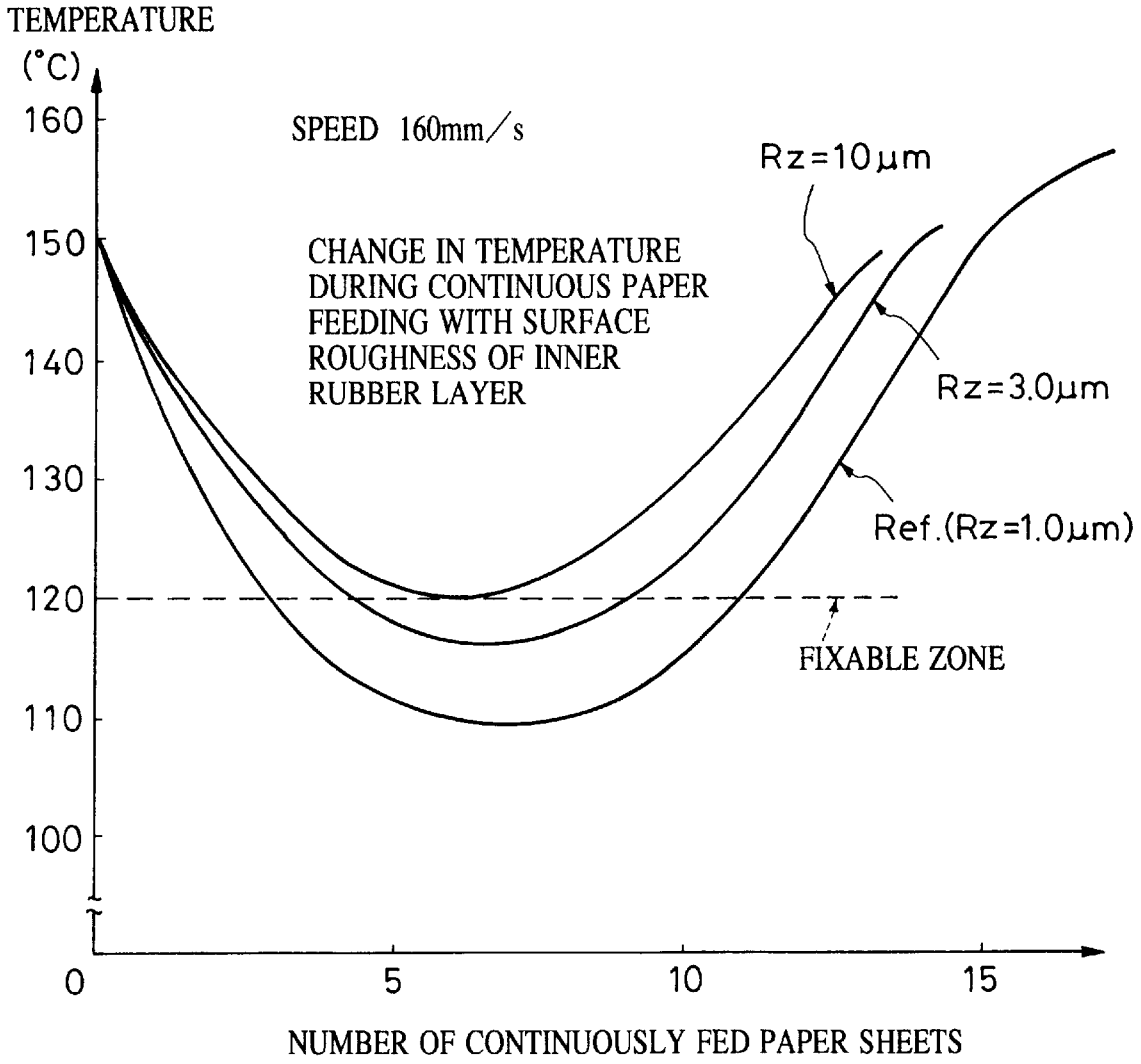
FIG. 7 is a graph illustrating the correlation between the temperature o the fixing roller and the number of continuously fed paper sheets in a fixing apparatus described in Example 1.
Figure 8:
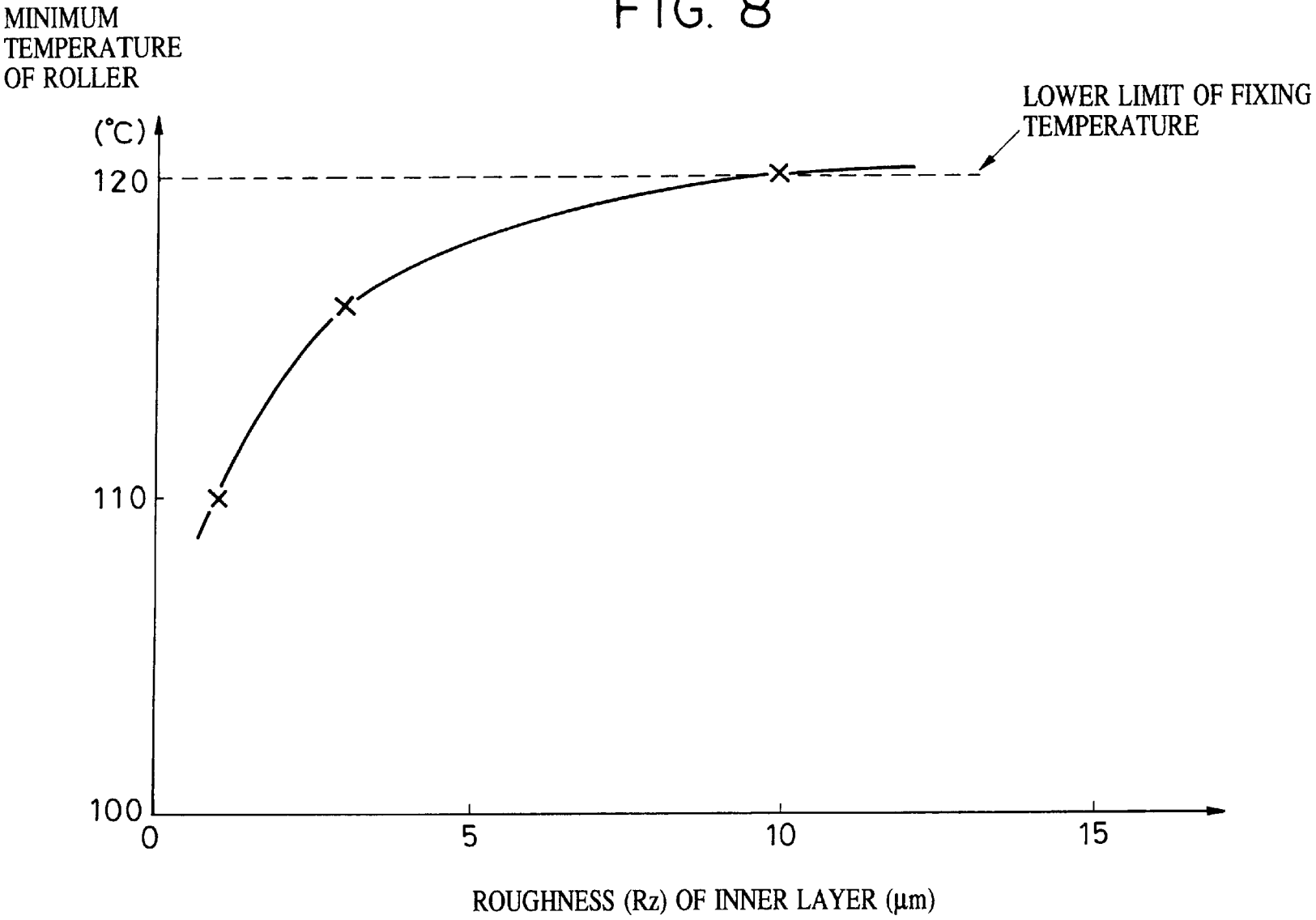
FIG. 8 is a graph illustrating the correlation between the surface roughness of the inner rubber layer and the temperature of a fixing roller.
Figure 9:
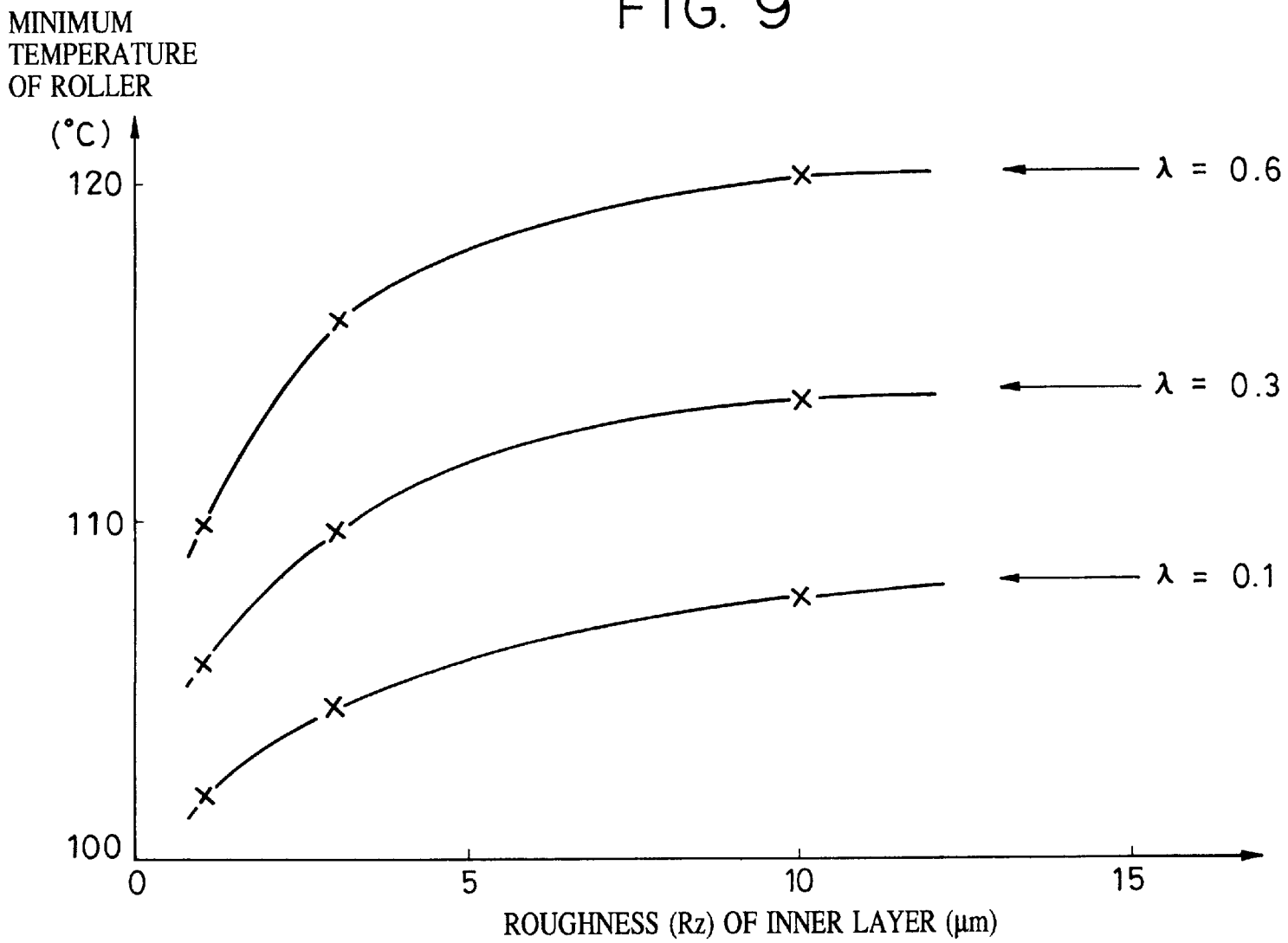
FIG. 9 is a graph illustrating a correlation between the surface roughness of the inner rubber layer and the temperature of a fixing roller of a fixing apparatus described in Example 2.

The surface roughness of the inner rubber layer is controlled by, for example, the above-mentioned grinding or by using a mold with a rough surface. The heat conductivity at various surface roughnesses is evaluated by the difference in the surface temperature of the roller when size A4 sheets are continuously fed at a speed of 1 sheet/5 sec. using an apparatus shown in FIG. 3. The results are shown in FIG. 7 and FIG. 8. FIG. 8 and FIG. 9 demonstrate that the temperature depression of the roller is moderated with the surface roughness of the inner rubber layer. In this example, the surface temperature of the roller reaches the lower limit of the fixing temperature at a surface roughness of greater than 10 μm.

Figure 3:
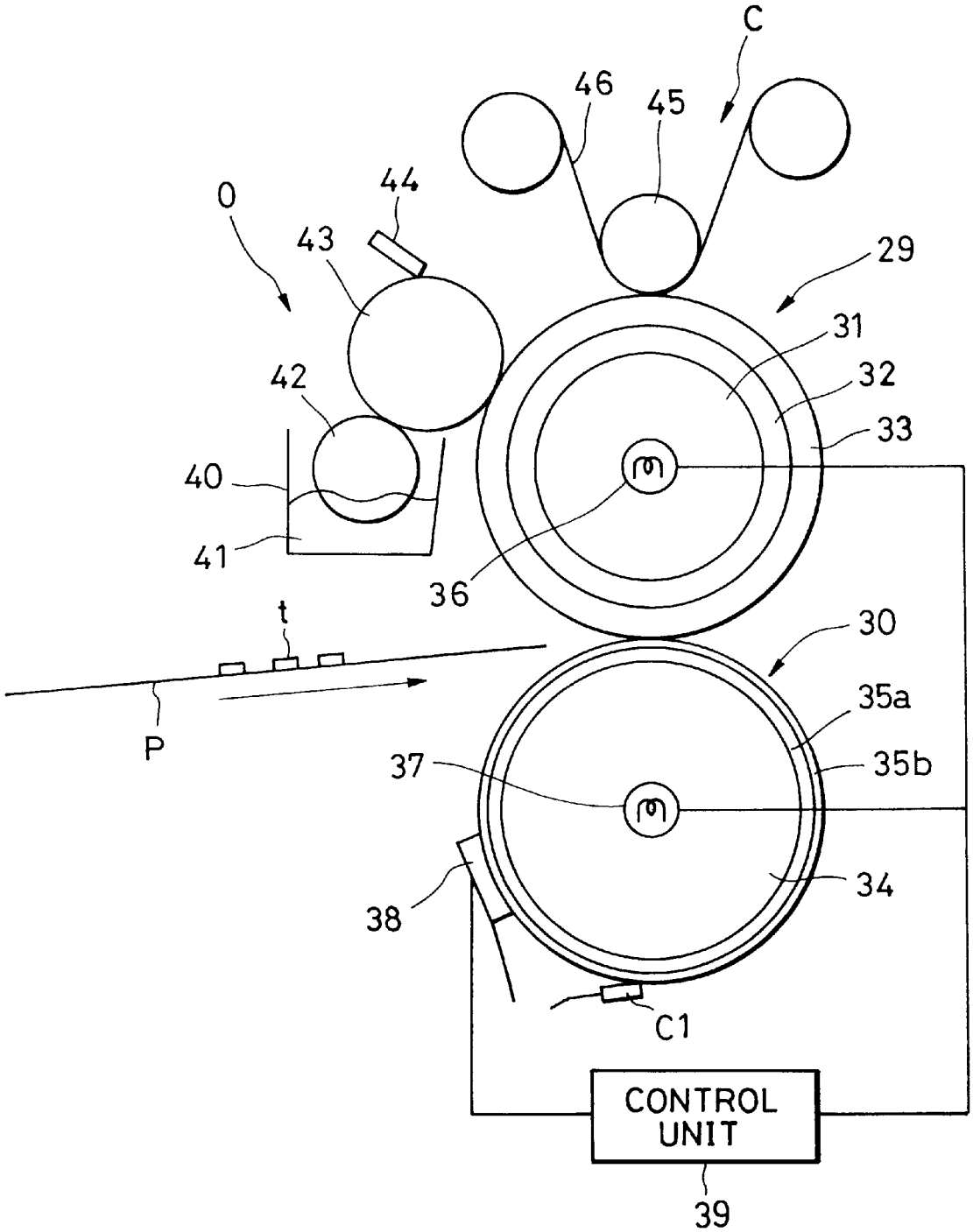
FIG. 3 is a cross-sectional view of a conventional fixing apparatus.
Figure 4:
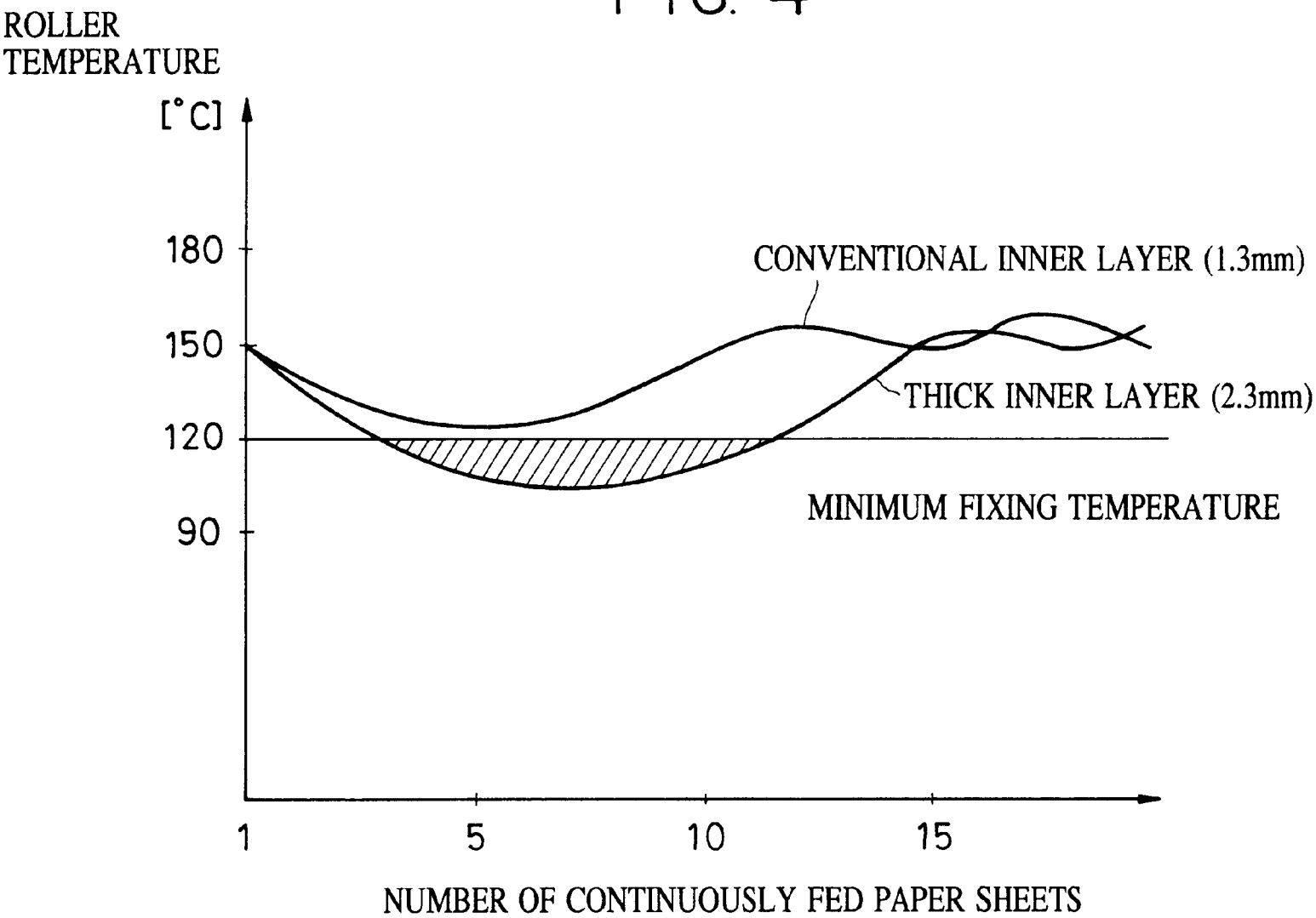
FIG. 4 is a graph illustrating the correlation between the temperature of the fixing roller and the number of continuously fed paper sheets in a conventional fixing apparatus.
Figure 5:
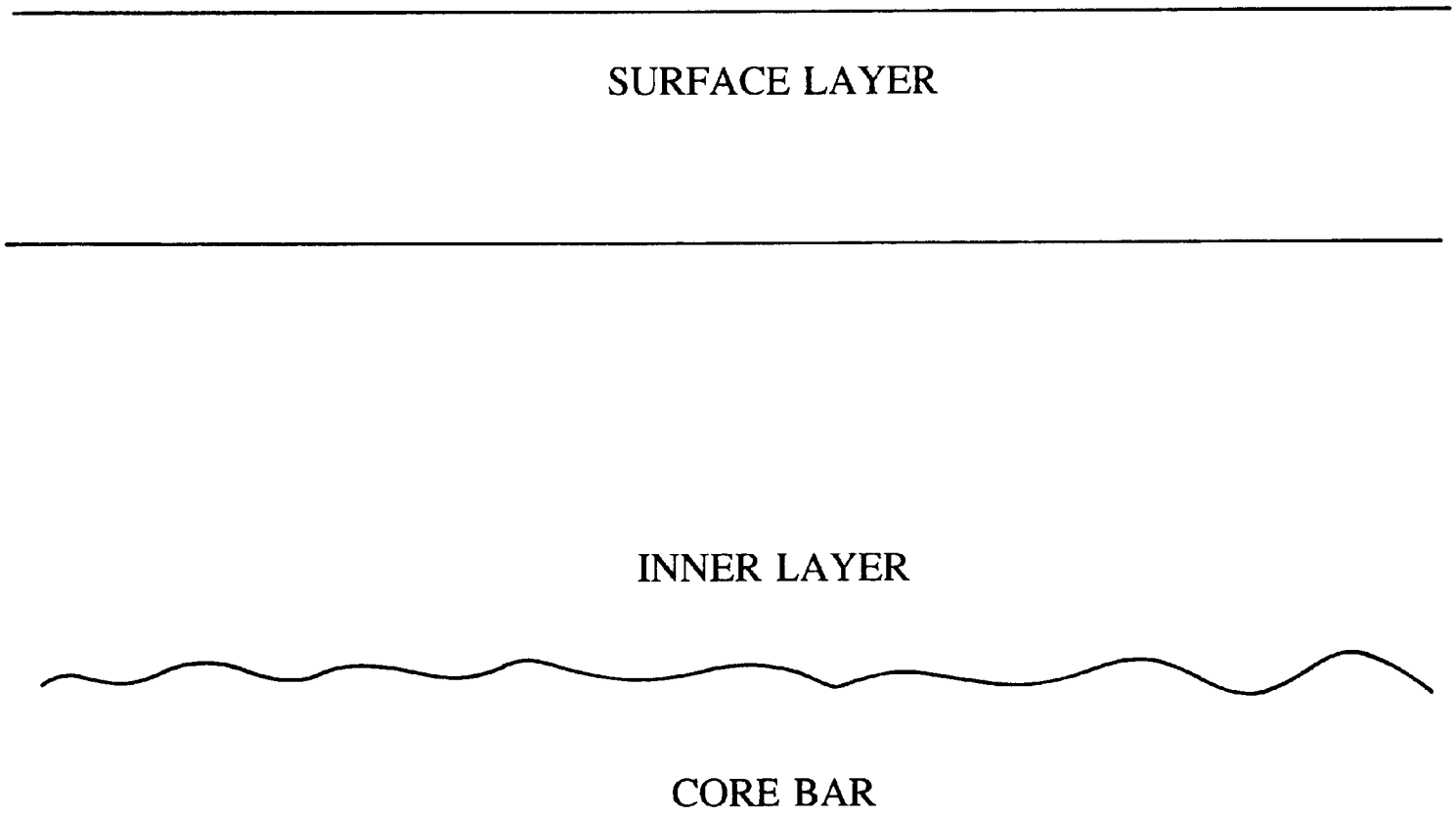
FIG. 5 is a cross-sectional view of a conventional roller.

As described above, the roller assembled into the fixing apparatus shown in FIG. 3 has excellent fixing characteristics for a toner having a fixing temperature of 120° C.

In the measurement of the surface roughness of the inner rubber layer, a sampling length of 0.8 mm and an evaluation length of 4 mm are employed.

EXAMPLE 2

In this example, the heat conductivity and roughness of the inner rubber layer are varied. A roller having the same configuration as in Example 1 is used. FIG. 9 is a graph illustrating the change in the minimum temperature of the roller with the heat conductivity λ of the inner rubber layer in a continuous feeding test. The minimum temperature of the roller surface increases with the increased surface roughness of the roller. Also, the minimum temperature of the roller surface increases with the increased heat conductivity λ. These results demonstrate that satisfactory fixing characteristics are achieved by adequately determining the heat conductivity and the surface roughness in response to the fixing temperature of the toner to be used.

The inner rubber layer of the above-mentioned roller has a thickness of 2.3 mm. Table 1 shows the lower limit of the heat conductivity λ at various thicknesses of the inner rubber layer for fixing a toner with a fixing temperature of 120° C., wherein the surface roughness is 10 μm.

TABLE 1

| Thickness of inner layer | Lower limit of heat conductivity λ |
|---|---|
| 1 mm | $0.4 \times 10^{-3}$ cal/cm · sec · deg |
| 2.3 mm | $0.6 \times 10^{-3}$ cal/cm · sec · deg |
| 3 mm | $0.9 \times 10^{-3}$ cal/cm · sec · deg |

A nip width of several mm and a thickness of the inner rubber layer of 2 mm or more are required for achieving sufficient heat supply to paper, hence it is preferable that the heat conductivity λ, be 0.6 or more and the surface roughness be 10 μm or more.

EXAMPLE 3

In this example, the hardness and surface roughness of the inner rubber layer are varied. The roller has the same configuration as in Example 1. Table 2 shows fixing characteristics of a toner having a fixing temperature of 120° C. at various hardnesses and surface roughnesses of the inner rubber layer. Table 2 illustrates that a harder inner rubber layer causes unsatisfactory fixing even if the inner rubber layer has a large surface roughness.

TABLE 2

| | | Hardness (degree) | | | | |
|---|---|---|---|---|---|---|
| | | 10 | 20 | 30 | 40 | 50 |
| Roughness Rz | 1 | A | B | B | C | C |
| | 5 | A | A | B | C | C |
| | 10 | A | A | A | C | C |

Roller load: 40 kgf
A: No toner peeling is observed in the bent paper.
B: Some white sections are observed on the bent line of the paper.
C: Toner peeling is observed at some places in the toner image on the paper fed from the fixing apparatus.

Unsatisfactory fixing in Table 2 occurs due to insufficient heat supply which is caused by a small nip width under a constant roller load of 40 kgf. If the load is increased, the paper sheet wrinkles.

When the load of the roller is increased from 40 kgf to 70 kgf, satisfactory fixing characteristics are achieved with a roller having a larger nip width and a higher hardness (40° C. or more), as shown in Table 3. Wrinkles, however, are observed on some images or in some types of paper.

TABLE 3

| | | Hardness (degree) | | | |
|---|---|---|---|---|---|
| | | 30 | 40 | 50 | 60 |
| Roughness Rz | 1 | A | A | B | C |
| | 5 | A | A | A | B |
| | 10 | A | A | A | B |

Table 3 illustrates that fixing characteristics depend on the surface roughness at a region of greater hardness.

Double-layer rollers are exemplified in Examples 1 to 3, these results stand in rollers consisting of three or more layers. In these cases, each of the inner layers may have a rough surface in order to further improve the heat transfer.

Rollers are exemplified as fixing members in the above examples. Belts having a multiple-layered structure also have similar advantages.

While the present invention has been described with reference to what are presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A fixing member comprising a plurality of elastic layers on a core member, at least one elastic layer L1 among these elastic layers being overlaid on an elastic layer L2 having a surface roughness Rz of at least 10 μm, wherein said elastic layer L2 has a heat conductivity of at least $0.6\times10^{-3}$ cal/cm.sec.deg, a hardness of 30° or less, and a thickness larger than that of said elastic layer L1, and wherein said elastic layer L1 and said elastic layer L2 comprises silicone rubber.

2. A fixing member according to claim 1, wherein the heat conductivity of said elastic layer L2 is higher than a heat conductivity of said elastic layer L1, and said elastic layer L2 is provided between said elastic layer L1 and the core member.

3. A fixing member according to claim 1, wherein said elastic layer L2 is provided between said elastic layer L1 and the core member.

4. A fixing member according to claim 1, wherein said elastic layer L2 has a thickness larger than that of said elastic layer L1 and is provided between said elastic layer L1 and the core member.

5. A fixing member according to claim 1, wherein said core member is a roller.

6. A fixing apparatus comprising a fixing member and a heating means, said fixing member comprising a plurality of elastic layers on a core member, at least one elastic layer L1 among these elastic layers being overlaid on an elastic layer L2 having a surface roughness Rz of at least 10 μm, wherein said elastic layer L2 has a heat conductivity of at least $0.6\times10^{-3}$ cal/cm.sec.deg, a hardness of 30° or less, and a thickness larger than that of said elastic layer L1, and wherein said elastic layer L1 and said elastic layer L2 comprises silicone rubber.

7. A fixing apparatus according to claim 6, wherein said core member is a roller and said heating means is provided inside said roller.

* * * * *

UNITED STATES PATENT AND TRADEMARK OFFICE

CERTIFICATE OF CORRECTION

PATENT NO. : 5,950,061

DATED : September 7, 1999

INVENTOR(S): MITSUHIRO OTA, ET AL.

It is certified that error appears in the above-identified patent and that said Letters Patent is hereby corrected as shown below:

COLUMN 1:
Line 26, "I," should read --I, a--.

COLUMN 4:
Line 38, "silicon" should read --silicone--.

COLUMN 5:
Line 40, "which, is higher than that of the elastic layer L1" should read --which is higher than that of the elastic layer L1,--.

COLUMN 6:
Line 35, "silicon" should read --silicone--; and
Line 36, "silicon" should read --silicone--.

UNITED STATES PATENT AND TRADEMARK OFFICE

CERTIFICATE OF CORRECTION

PATENT NO. : 5,950,061

DATED : September 7, 1999

INVENTOR(S): MITSUHIRO OTA, ET AL.

It is certified that error appears in the above-identified patent and that said Letters Patent is hereby corrected as shown below:

COLUMN 8:

Line 39, "comprises" should read --comprise--; and

Line 62, "comprises" should read --comprise--.

Signed and Sealed this

Eleventh Day of July, 2000

*Attest:*

Q. TODD DICKINSON

*Attesting Officer*

*Director of Patents and Trademarks*